US007614093B2

(12) United States Patent
Piche et al.

(10) Patent No.: US 7,614,093 B2
(45) Date of Patent: Nov. 10, 2009

(54) VERTICALLY ACTUABLE ROOF COVER FOR A SPA

(75) Inventors: Mario Piche, Calgary (CA); Raymond Bussiere, Calgary (CA)

(73) Assignee: Sterling Holdings Corporation, Calgary (CA)

( * ) Notice: Subject to any disclaimer, the term of this patent is extended or adjusted under 35 U.S.C. 154(b) by 762 days.

(21) Appl. No.: 11/306,728

(22) Filed: Jan. 9, 2006

(65) Prior Publication Data

US 2007/0017017 A1 Jan. 25, 2007

Related U.S. Application Data

(63) Continuation-in-part of application No. 11/162,557, filed on Sep. 14, 2005.

(30) Foreign Application Priority Data

Jul. 23, 2005 (GB) ..... 0515168.3

(51) Int. Cl.
*E04H 4/00* (2006.01)

(52) U.S. Cl. ..... 4/498

(58) Field of Classification Search ..... 4/498, 4/503; 296/110.15, 115, 171, 177
See application file for complete search history.

(56) References Cited

U.S. PATENT DOCUMENTS 3,395,777 A 8/1968 Rodosta
3,566,420 A 3/1971 Peterson et al.
3,679,174 A 7/1972 Boettcher
4,078,293 A 3/1978 Aine
4,165,543 A 8/1979 Reinert
4,426,744 A 1/1984 Love
4,598,506 A 7/1986 Nohl et al.
5,035,094 A 7/1991 Legare
5,745,932 A 5/1998 Barovetto
6,196,604 B1 * 3/2001 Hoh et al. ..... 296/26.05
6,718,566 B1 * 4/2004 Wilson ..... 4/498
7,128,003 B2 * 10/2006 Okninski ..... 108/147

FOREIGN PATENT DOCUMENTS

CA 2379281 9/2002
DE 2521829 5/1975
FR 2555219 5/1985

* cited by examiner

*Primary Examiner*—Huyen Le
(74) *Attorney, Agent, or Firm*—Sean W Goodwin; Linda M. Thompson

(57) ABSTRACT

An actuator and an assembly utilizing two or more actuators for vertically actuating a cover for a spa. In the lowered position the cover protects the spa and in the elevated position the cover acts as a roof over the spa. The actuator is either a rack and pinion assisted by a cable and pulley or a chain and a plurality of sprockets assisted by a cable and pulley which are connected to lift member which are generally shrouded by telescoping tubes to cover the actuators or to act as lift members themselves. The system can be further enhanced using a gas spring to assist in lifting the cover and reduce the load of the cover weight off the motor which is used to actuate the actuators.

36 Claims, 12 Drawing Sheets

VERTICALLY ACTUABLE ROOF COVER FOR A SPA

CROSS REFERENCE TO RELATED APPLICATION

This application is a continuation in part of U.S. application Ser. No. 11/162,557 filed on Sep. 14, 2005, which is hereby incorporated by reference.

FIELD OF THE INVENTION

Embodiments of the invention relate to spa covers and more particularly to spa covers which are moveable vertically between a position directly atop the spa and a position elevated above the spa to act as a roof structure during spa use.

BACKGROUND OF THE INVENTION

It is known to cover hot tubs or spas to prevent contamination due to environmental debris, such as leaves, pollens and the like, to prevent excessive evaporation when the spa is not in use and to act as a safety measure to prevent animals, small children and the like from falling into the water when unsupervised.

Most conventional spa covers are fabric covered foam structures which rest atop the spa when the spa is not in use and which are removed, either by sliding off the tub or by folding at a middle and lifting to a position away from the top of the tub, such by a support frame wherein the cover is suspended vertically in the folded position adjacent a side of the tub. The fabric covers may be susceptible to chemical vapors, such as chlorine, are prone to tearing at seams exposing the foam layers to the elements and to the steam and vapors from the tub and are generally susceptible to normal wear and tear necessitating multiple replacements during the life of the average spa.

It is known to provide fixed structures built around the hot tub to provide an element of protection for use during inclement weather or to prevent excessive exposure to the sun. Most often the structure is independent of the cover and remains in a fixed position around the tub, the roof portion being fixed above the spa to permit use of the spa. While these structures may meet the needs of the user by providing a rigid or semi rigid roof structure, they add additional expense by requiring a spa cover to be used as well.

Conventional spa covers are not designed to handle the weight of a person or persons resting on the cover. As the spa covers are typically flat however, individuals may be encourage to walk or otherwise provide undue weight on the cover, such as when shoveling snow from a deck in which the spa is recessed, which results in damage not only to the cover but to the spa itself.

Others have attempted to provide domed rigid or semi-rigid cover structures which, like the conventional cover, reside atop the spa when in use and which are pivoted or slid laterally away from the spa when the spa is to be used.

It is known to provide a vertically actuable cover to a swimming pool or a spa. U.S. Pat. No. 3,566,420 to Peterson et al teaches hydraulic actuators used to raise and lower a cover from a swimming pool and U.S. Pat. No. 6,718,566 to Wilson teaches a plurality of telescoping and threaded sections which are used to raise and lower a cover over a spa.

There remains interest in the industry to find reliable, relatively simple and inexpensive lift systems for raising and lowering roof structures over spas, which can act to replace a conventional spa cover when in a lowered, spa engaging position and which act as a roof when in the raised position.

SUMMARY OF THE INVENTION

A cover assembly for a structure, such as a spa, is vertically actuated between a lowered position atop the spa to an elevated position above the spa where the cover acts as a roof over the spa. The actuation of the cover is accomplished using actuation members which support the cover and which employ unique lifting means, such as a rack and pinion system or a tension member and rotatable guides, powered by a motor. The lifting means are housed within telescoping tubular members which act to provide an aesthetic covering for the lifting means and which may or may not form a part of the lifting means structure.

In a broad aspect therefore, a vertically-actuable cover assembly for a structure comprises: a cover; and two or more actuation members for supporting the cover, the two or more actuation members being actuable between a lowered position atop the structure to an elevated position above the structure so as to act as a roof thereover, wherein the two or more actuation members further comprise: a first lift structure mounted on a base fixed relative to the structure; a second lift structure operatively connected to the first lift structure and actuable to be raised and lowered for raising and lowering the cover; a third upper lift structure operatively connected to the second lift structure; a rotatable guide supported adjacent a top end of the second lift structure; a cable connected between the first structure and extending about the rotatable guide for connection to a bottom end of the third lift structure; and drive means for driving the second lift structure to be lifted and lowered relative to the first lift structure, wherein the rotatable guide is lifted and lowered by the second lift structure so as to passively cause the cable to lift the upper lift structure relative to the second lift structure.

The cover is supported on a plurality of actuation members, typically one at each corner of the cover, having one or more motors. In a preferred embodiment, a plurality of electric motors are connected through a single circuit so as to coordinate the actuation members to support and vertically actuate the cover.

Preferably, stops are formed at top and bottom ends of the telescoping tubular members to limit the upward travel of the telescoping members within each other to prevent the telescoping members from becoming disconnected during elevation of the cover and to lift the intermediate member with the upper tubular member.

In one embodiment, a rack and pinion lifting system is used wherein the first lift structure is a pinion or worm gear mounted on a rotatable shaft, the second lift structure is a rack and the third lift structure is the upper telescoping member which supports the cover. An electric motor drives the shaft to rotate the worm gear which in turn engages the rack to be lifted and lowered along with the structures connected thereto. A cable is connected between the rack and an upper telescoping member, which forms part of the lifting structure and upon which the cover is supported, for assisting in raising and lowering cover. The cable is guided by a pulley which is connected at a top end of the rack. As the rack is moved so is the pulley at the top of the rack which causes the cable to passively lift or lower the upper telescoping member to raise and lower the cover. Limit switches act to stop the motor when the cover has reached the elevated or lowered position.

In an alternate embodiment, a tension cable and rotatable guide system is used wherein the first lift structure is a housing mounted on a base for telescopically housing a linearly extending member and the drive means is a tension member which is driven about a plurality of rotatable guides which are positioned at the top and bottom of the housing and the top and bottom of the second lift structure. One of the rotatable guides, preferably the guide at the bottom of the housing, is driven by a motor. The third lift structure is a linearly extending member telescopically housed in the second lift structure and to which the cover is connected In a preferred embodiment the tension member is a chain or belt and the rotatable guide are sprockets. Further a biasing means, such as a hydraulic cylinder is provide to assist in lifting the second lift structure. The pulley over which the cable extends is rotatably connected by a bracket adjacent the top of the second lift structure and further to a hydraulic arm of the hydraulic cylinder. The cylinder arm is driven upwards as the chain lifts the second lift structure thus reducing the load on the motor.

DETAILED DESCRIPTION OF THE PREFERRED EMBODIMENT

Figure 1:
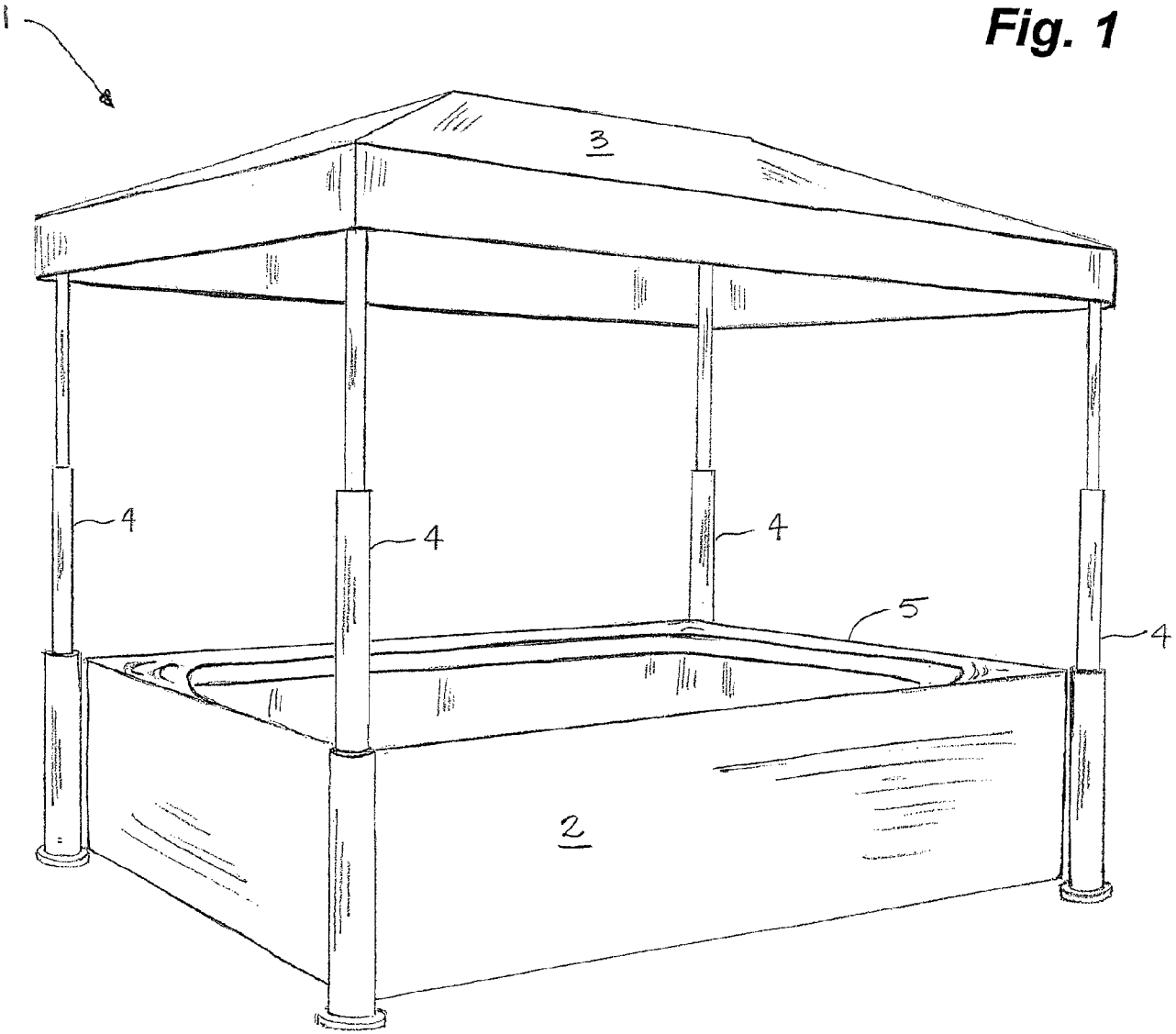
FIG. 1 is a perspective view of a spa cover according to one embodiment, shown in a raised position.
Figure 2:
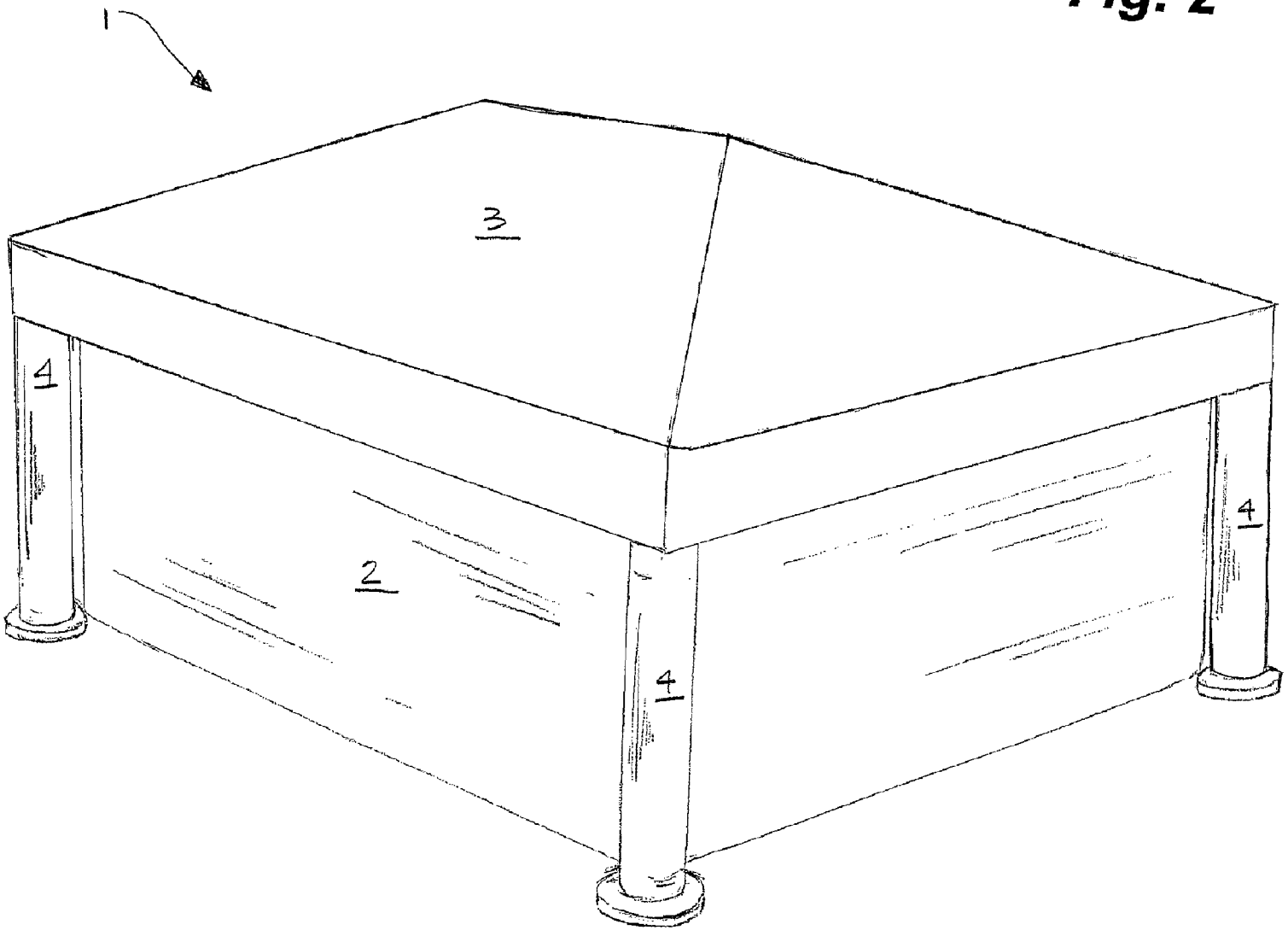
FIG. 2 is a perspective view according to FIG. 1 shown in a lowered position.

Having reference to FIGS. 1 and 2, a cover apparatus 1 for a structure 2, such hot tub or spa, comprises a cover 3 supported on actuation members 4, typically positioned at each corner of the spa 2. The actuation members 4 elevate the cover 3 from a lowered position, wherein the cover 3 rests atop or adjacent a top edge 5 of the spa 2, to a raised position, wherein the cover 3 is supported over the spa 2 to act as a roof.

Figure 3A:
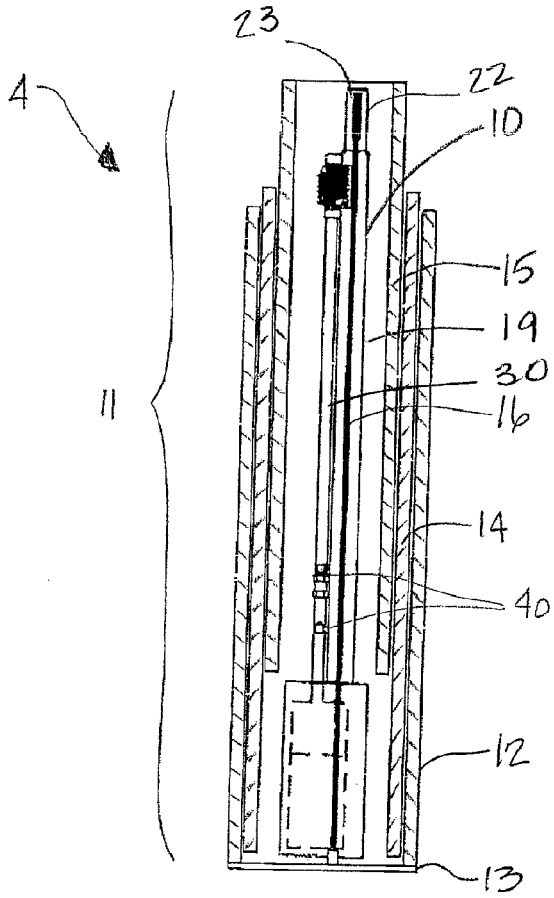
FIG. 3*a* is a longitudinal sectional side view of an actuation mechanism for raising and lowering the spa cover, shown in the lowered position.
Figure 3B:
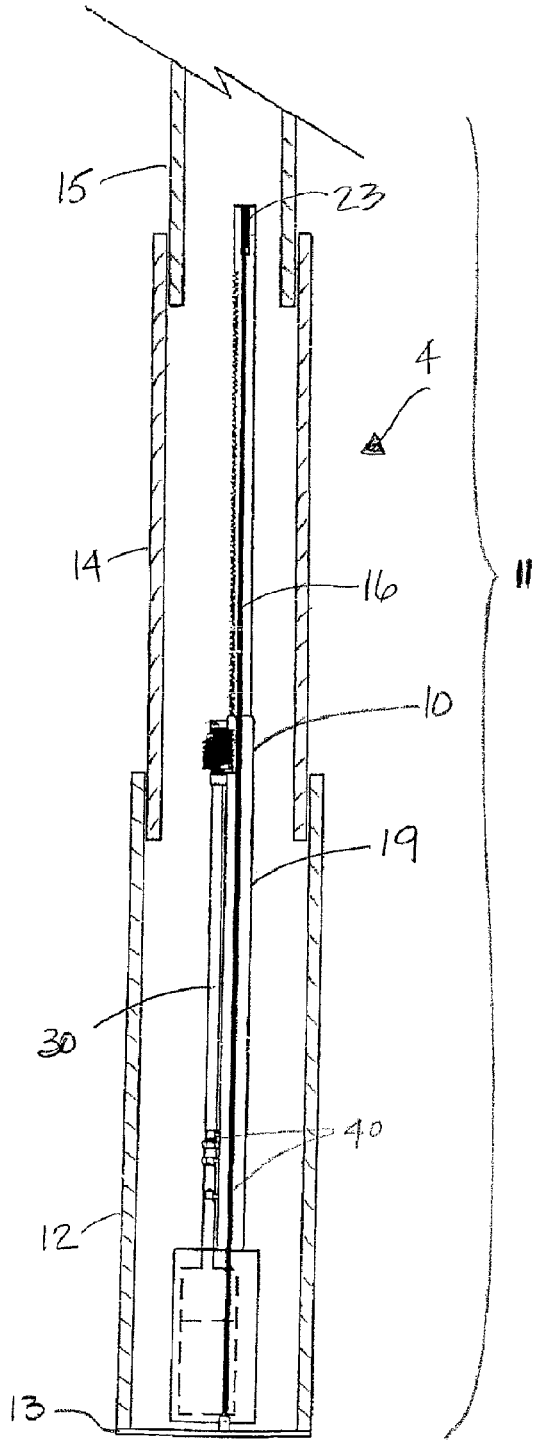
FIG. 3*b* is a longitudinal sectional side view according to FIG. 3*a*, shown in the raised position.
Figure 4A:
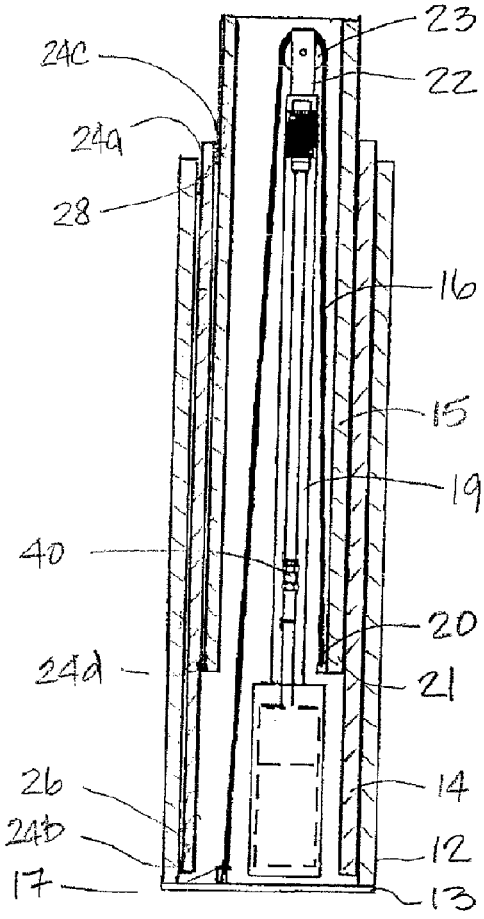
FIG. 4*a* is a longitudinal sectional front view according to FIG. 3*a*, in the lowered position.
Figure 4B:
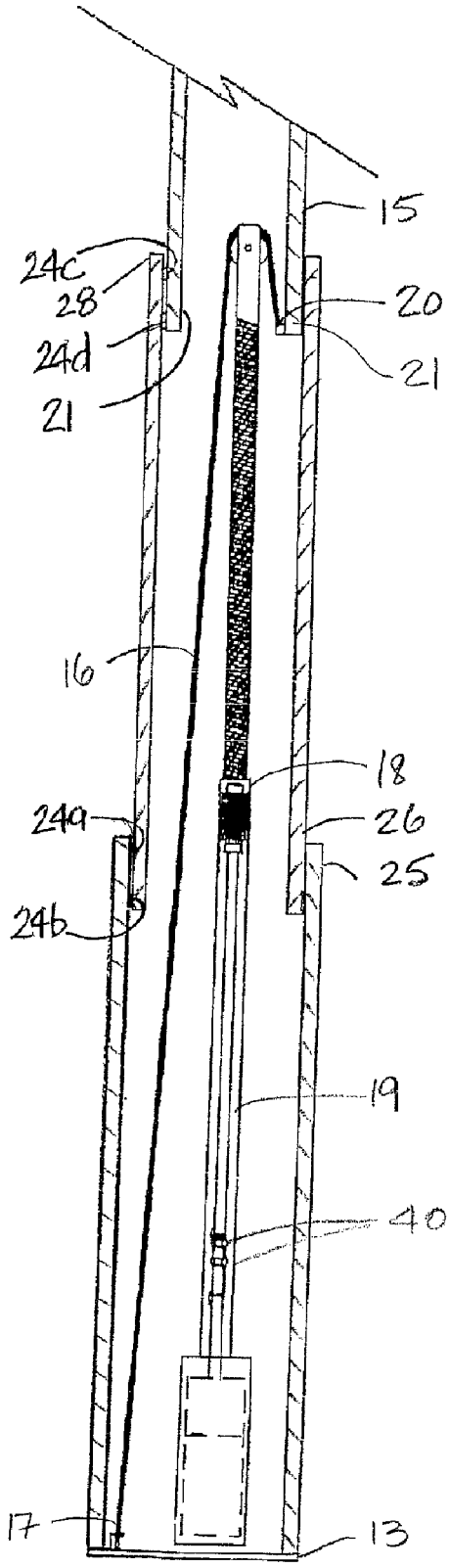
FIG. 4*b* is a longitudinal sectional front view according to FIG. 3*a*, in the raised position.
Figure 5:
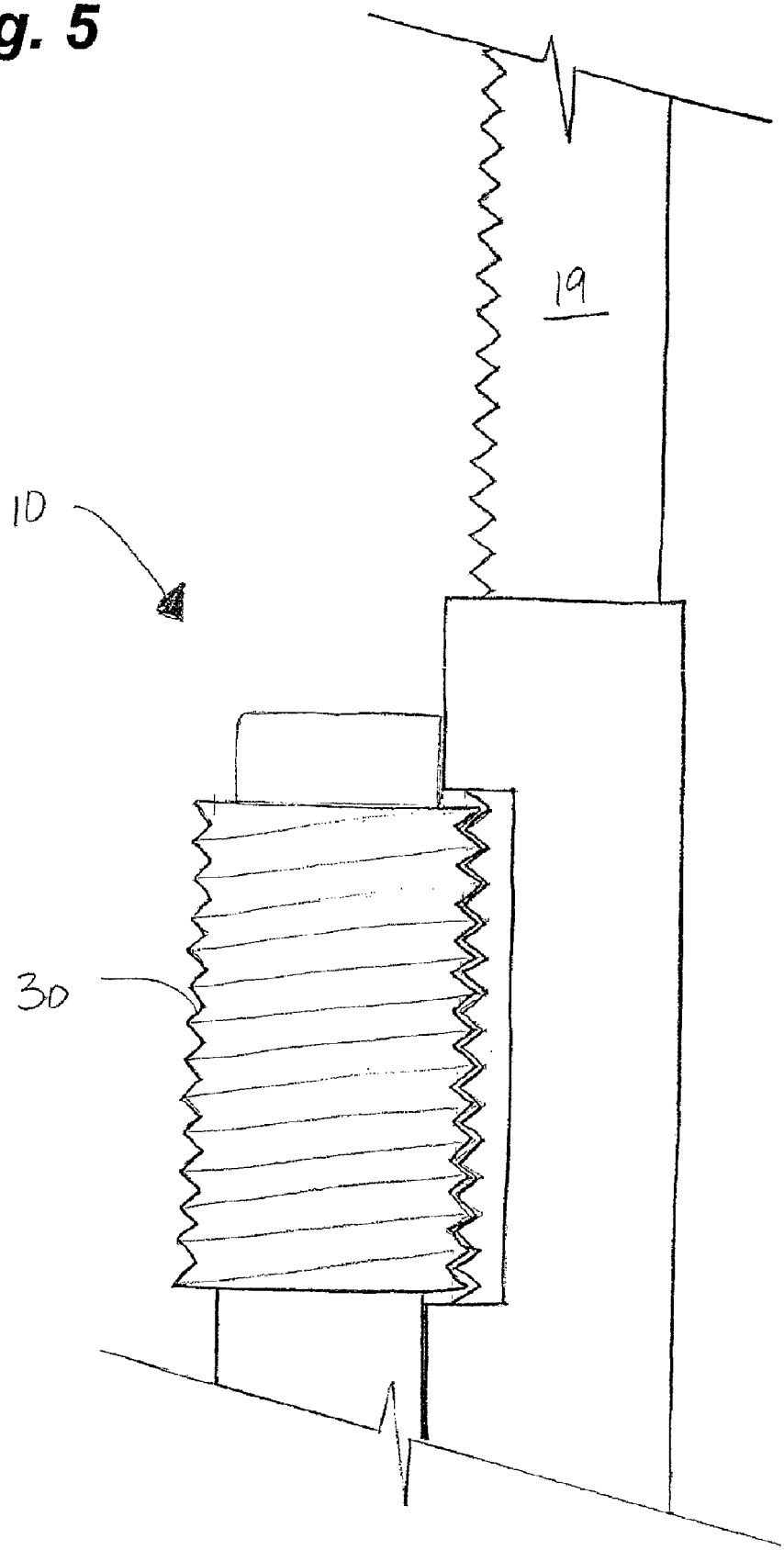
FIG. 5 is a detailed view of an embodiment of the actuation mechanism, more particularly a worm gear and rack.
Figure 11:
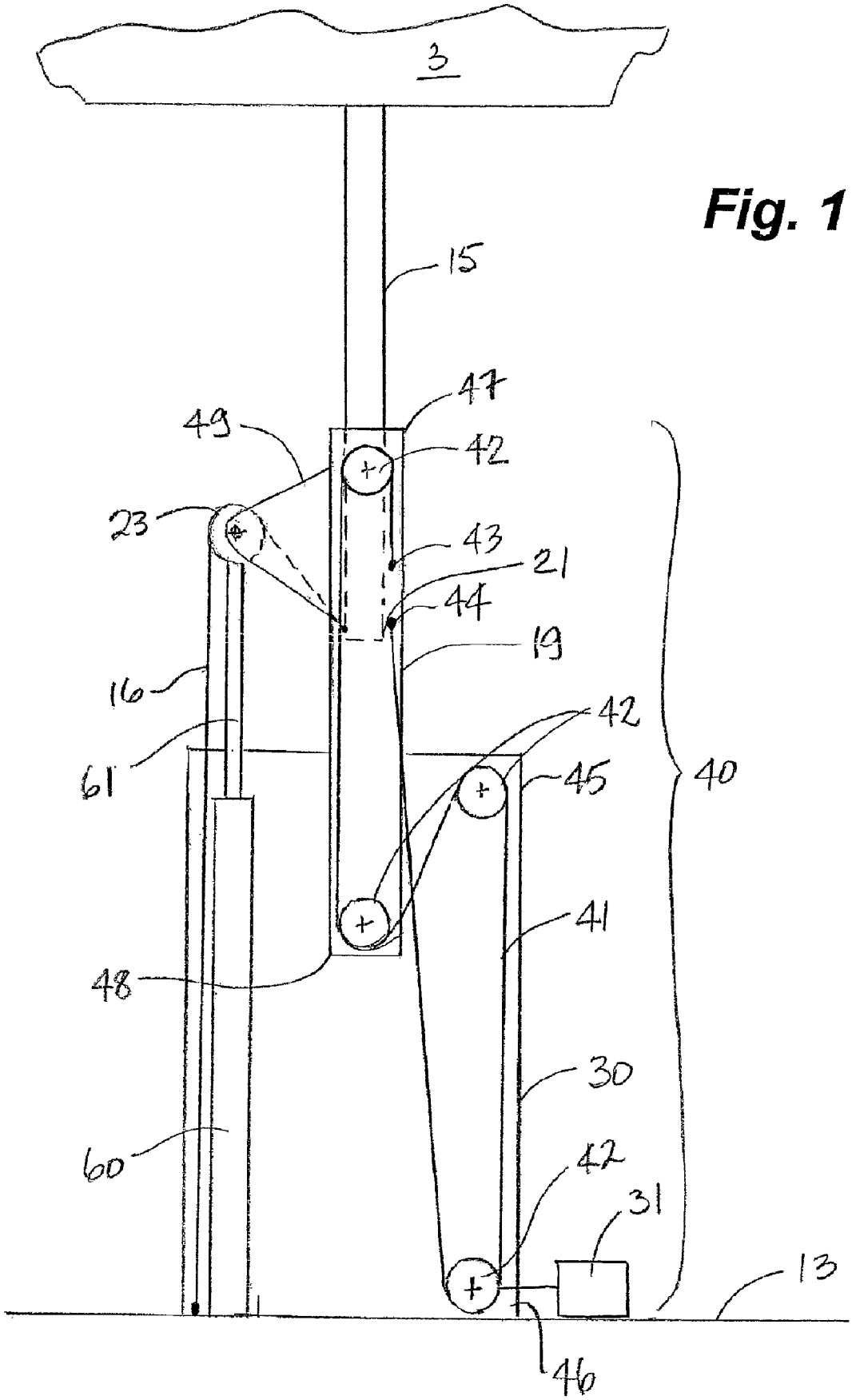
FIG. 11 is a schematic of another embodiment of the actuation mechanism, more particularly a tension member and rotational guide system, shown in a raised position, the telescoping tubular members having been removed for clarity.

As shown in FIGS. 3*a*, 3*b* and 11, the actuation members 4 comprise a first lift structure 30 mounted on a base 13 fixed relative to the structure 2. A second lift structure 19 is operatively connected to the first lift structure 30 and is actuable to be raised and lowered relative thereto for raising and lowering the cover 3 supported thereon. A third upper lift structure 15 is operatively connected to the second lift structure 19 and actuable to be raised and lowered relative thereto. A rotatable guide, such as a pulley 23, is supported adjacent a top end of the second lift structure 19 and a first flexible tension member such as a cable 16 is connected between the first structure 30 or the base 13 and extending about the rotatable guide 23 for connection to a lower end 21 of the third lift structure 15. Drive means 40, powered by a motor 31, is provided for driving the second lift structure 19 to be lifted and lowered relative to the first lift structure 30 and in doing so lifts the rotatable guide 23 to passively cause the cable 16 to lift the upper lift structure 15 relative to the second lift structure 19.

As shown in FIGS. 3*a*-6 and in one embodiment, the actuation members 4 comprise a rack and pinion system 10 for raising and lowering the cover 3. Each actuation member 4 is housed within two or more telescoping tubular members 11. The tubular members 11 may be, but are not limited to being circular, rectangular or square in cross-section. Further, the tubular members can form a part or all of the lift structures 30, 19 15 or shroud same. Preferably, each actuation member 4 is housed within three telescoping tubular members 11, a lower tubular member 12 secured to the base 13, an intermediate tubular member 14 and an upper tubular member 15 upon which the cover 3 is supported. The rack and pinion system 10 is connected thereto for active actuation of at least the second lift structure 19 and with it the intermediate tubular member 14. The upper tubular member acts is the third lift structure 15 and is connected thereto through cable 16 which is anchored, at a first end 17, to the base 13 or to an upper end 18 (FIG. 6) of a rack 19 of the rack and pinion system 10 for movement therewith and, at a second end 20, to a lower end 21 of the upper tubular member 15. The cable 16 is guided at an upper end 22 of the rack 19 by the pulley 23.

Figure 7:
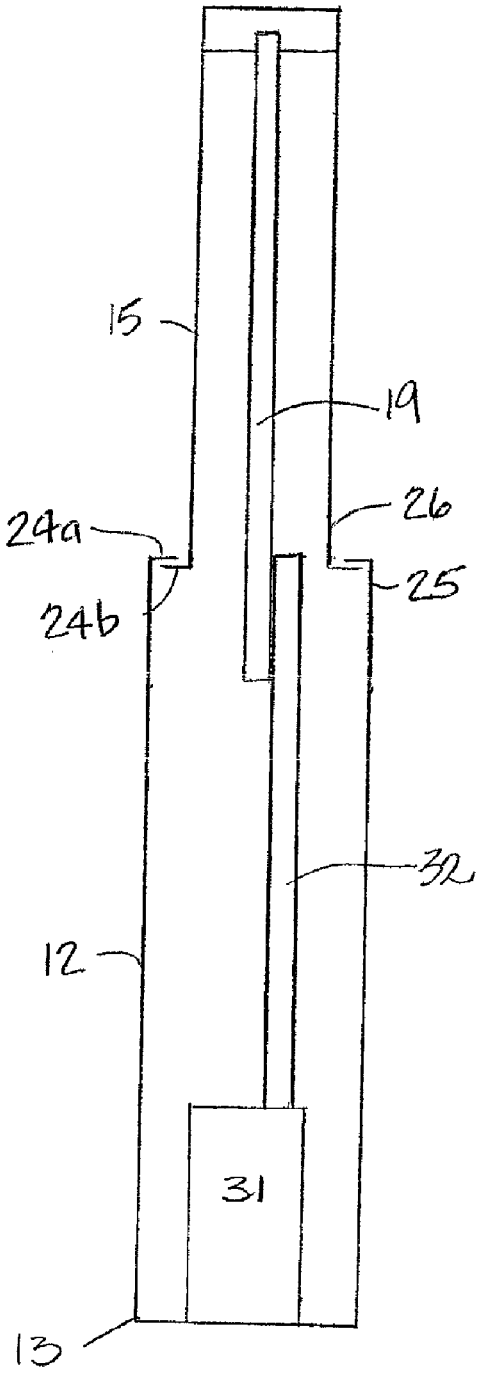
FIG. 7 is a schematic sectional view of an embodiment of an actuation mechanism having two telescoping tubular members, the upper tubular member being connected to the rack.
Figure 8:
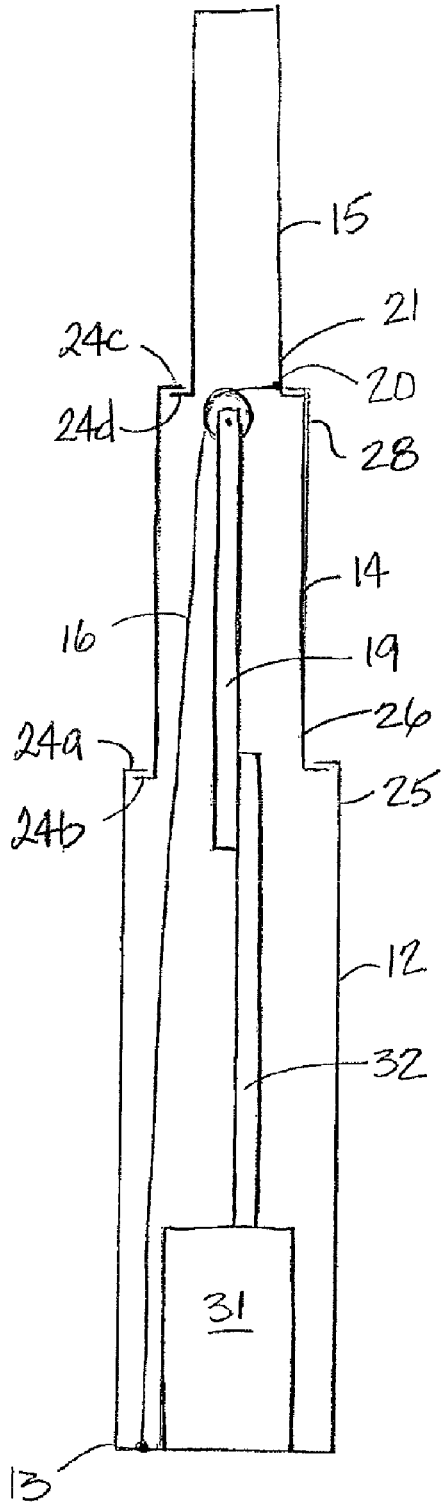
FIG. 8 is a schematic section view of an embodiment of the invention according to FIGS. 3*a*-4*b* having three telescoping tubular members, the upper tubular member being connected passively to the rack through a cable and pulley.

With reference to FIGS. 7 and 8, preferably, a stop 24*a* is formed at an upper end 25 of the lower tubular member 12 for engaging a stop 24*b* at a lower end 26 of the intermediate tubular member 14 for retaining the intermediate telescoping tubular member 14 in the lower telescoping tubular member 12 and to prevent the intermediate tubular member 14 from being pulled out of the lower tubular member 12, when the cover apparatus 1 is actuated to the raised position. Similarly, a stop 24*c* is formed at an upper end 28 of the intermediate member 14 for engaging a stop 24*d* at the lower end 21 of the upper tubular member 15 for retaining the upper tubular member 15 within the intermediate tubular member 14 during actuation to the elevated position.

Figure 6:
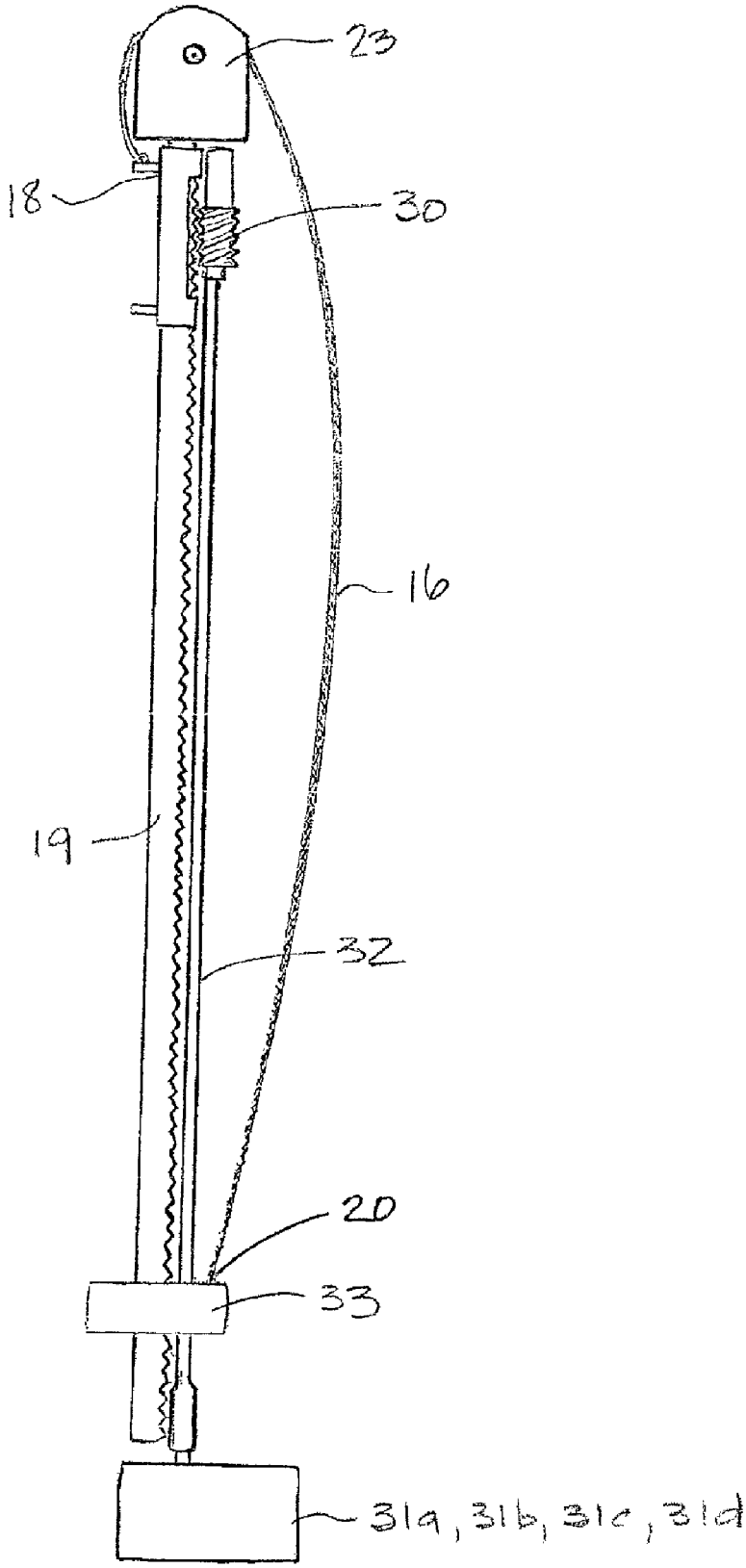
FIG. 6 is a perspective view of the worm gear and rack of FIG. 5 shown in the lowered position and illustrating an alternate embodiment for connection of the upper tubular member

Best seen in FIGS. 6-8, the rack and pinion system 10 comprises a worm gear 30 which is rotatably connected to the drive means 40, such as an electric gear motor 31, by a rod 32. The worm gear 30 is rotated to raise and lower the rack 19. For an actuation member 4 having two telescoping tubular members 11 (FIG. 7), rack 19 directly raises upper telescoping member 15. In the case of an actuation member 4 having three telescoping tubular members 11 (FIG. 8), the rack 19 raises and lowers the upper telescoping member 15 via the cable 16, the upper tubular member 15 raising and lowering the intermediate tubular member 14 through engagement of the stops 24*c*, 24*d*. As shown in FIG. 6, the cable 16 is connected at the second end 20 to a ring 33 which is used for mounting the cable 16 inside the lower end 21 of the upper tubular member 15.

Figure 10:
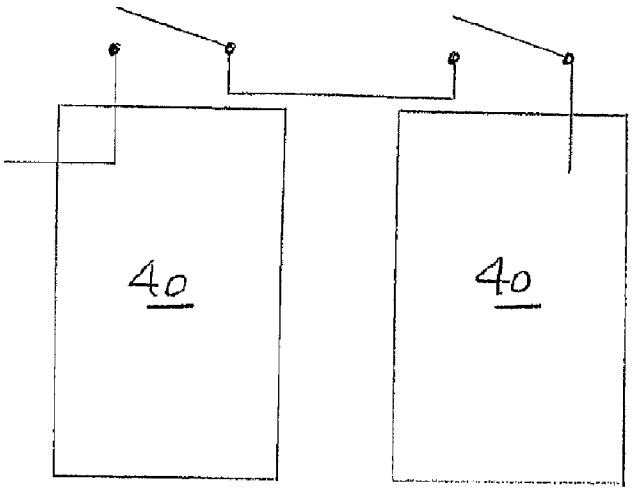
FIG. 10 is a schematic of a circuit for operating the plurality of gear motors according to FIG. 9, in series.
Figure 9:
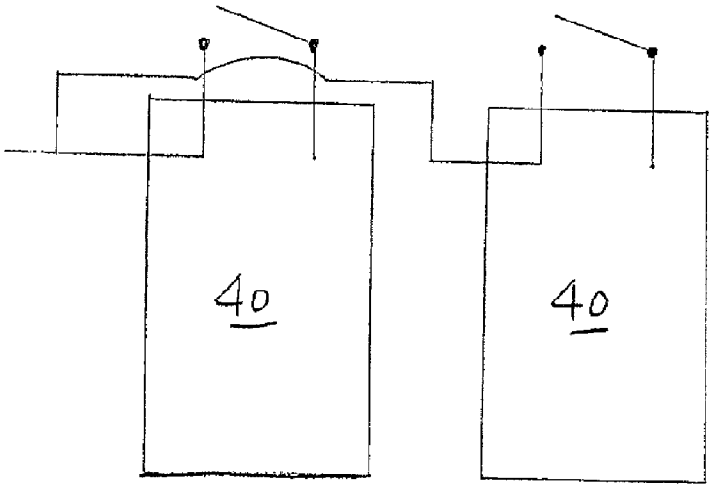
FIG. 9 is a schematic of a circuit for independently operating of a plurality of gear motors for rotationally powering worm gears.

Preferably, each actuation member 4 is powered by an electric gear motor 31. Most preferably, all of the gear motors 31*a*, 31*b*, 31*c*, 31*d* are connected through a single circuit so that when the circuit is activated, all of the actuation members 4 are caused to move at the same time. Limit switches 40 are positioned on the rack and pinion system 10 to stop the gear motor 31 when the cover 3 has reached the lowered or the raised position. As shown in FIGS. 9 and 10, the gear motor limit switches 40 may be independent (FIG. 9) or in series (FIG. 10).

In an alternate embodiment as shown in FIGS. 11-14, the first lift structure 30 is an upwardly linearly extending lower housing which is connected to the base 13. Best seen in FIG. 14, the second lift structure 19 is an intermediate linearly extending member which is housed telescopically within the lower housing 30 and the third lift structure 15 is an upper, linearly extending member which is housed telescopically within the intermediate member 19.

The drive means 40 comprises a durable, flexible tension member 41, such as a chain or belt and a plurality of rotational guides 42, such as sprockets or pulleys. At least one of the rotational guides is connected to a motor 31, such as an electric gear motor for driving the tension member 41 thereabout.

The tension member 41 is arranged in a FIG. 8 having two rotational guides 42 in one loop and two rotational guides 42 in the other loop. Actuation causes the one loop to be displaced relative to the other loop, raising one lift structure relative to the other.

Figure 12:
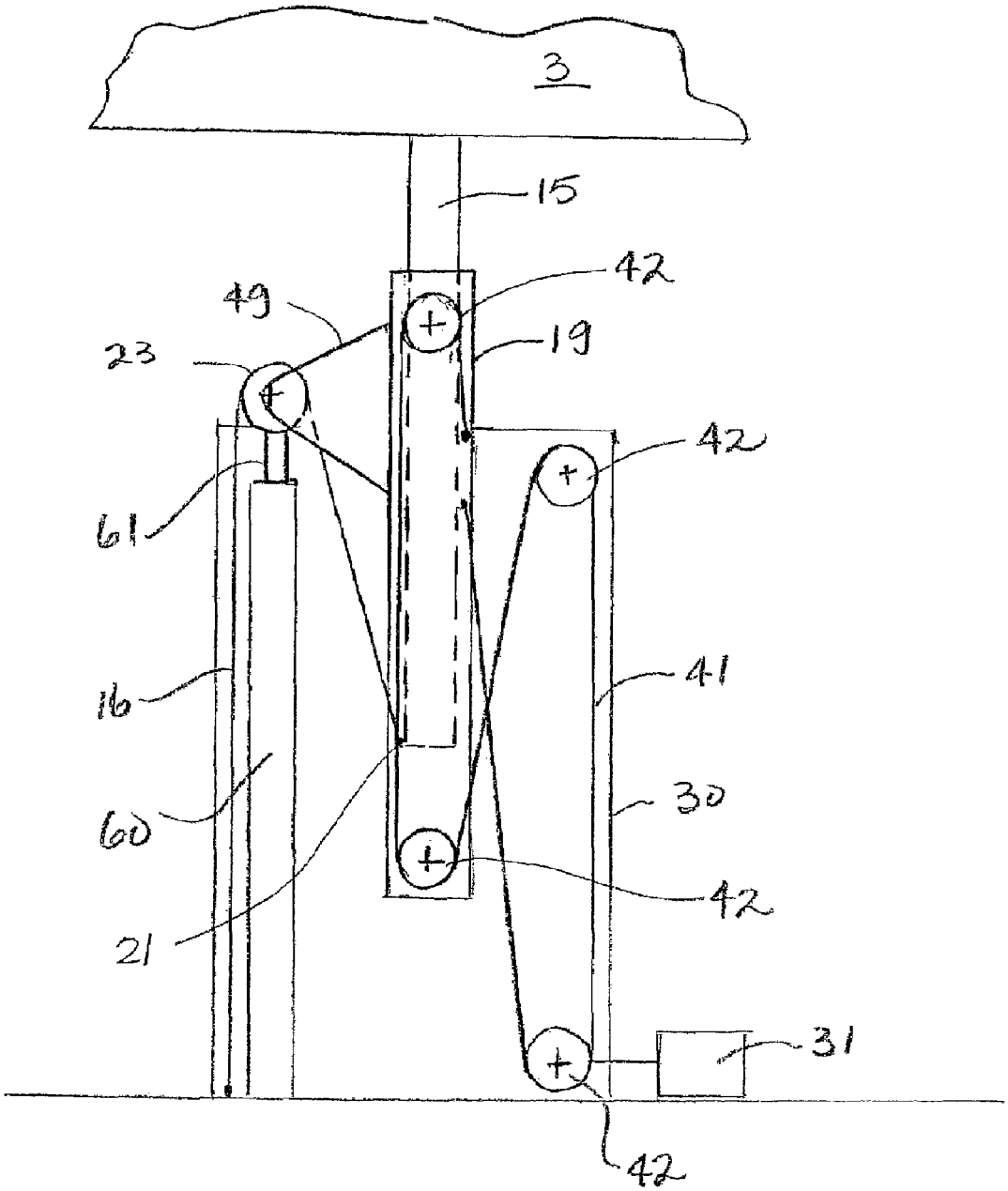
FIG. 12 is a schematic of the embodiment according to FIG. 11, in a lowered position.

As shown in FIGS. 11 and 12, the tension member 41, such as a UNIFLEX™ belt available from Jason Industrial Inc. of Fairfield N.J., 07004, USA, is connected at either end 43, 44 to the intermediate member 19 and passes about rotational guides 42 positioned at a top 45 and bottom 46 of the lower housing 30 (a first loop) and at a top 47 and bottom 48 of the intermediate member 19 (A second loop). As the motor 31 drives the at least one rotational guide 42, the intermediate member is raised (FIG. 11) and lowered (FIG. 12).

As in the previously described embodiment, the cable 16 is connected to the lower end 21 of the upper member 15. The pulley 23 is connected to the intermediate member 19 through a bracket 49. As the intermediate member 19 is raised and lowered, the pulley 23 is also raised and lowered causing the length of the cable 16 between the pulley 23 and lower end 21 to shorten as the intermediate member 19 raises, causing cable 16 to passively raise and lower the upper member 15.

Figure 13:
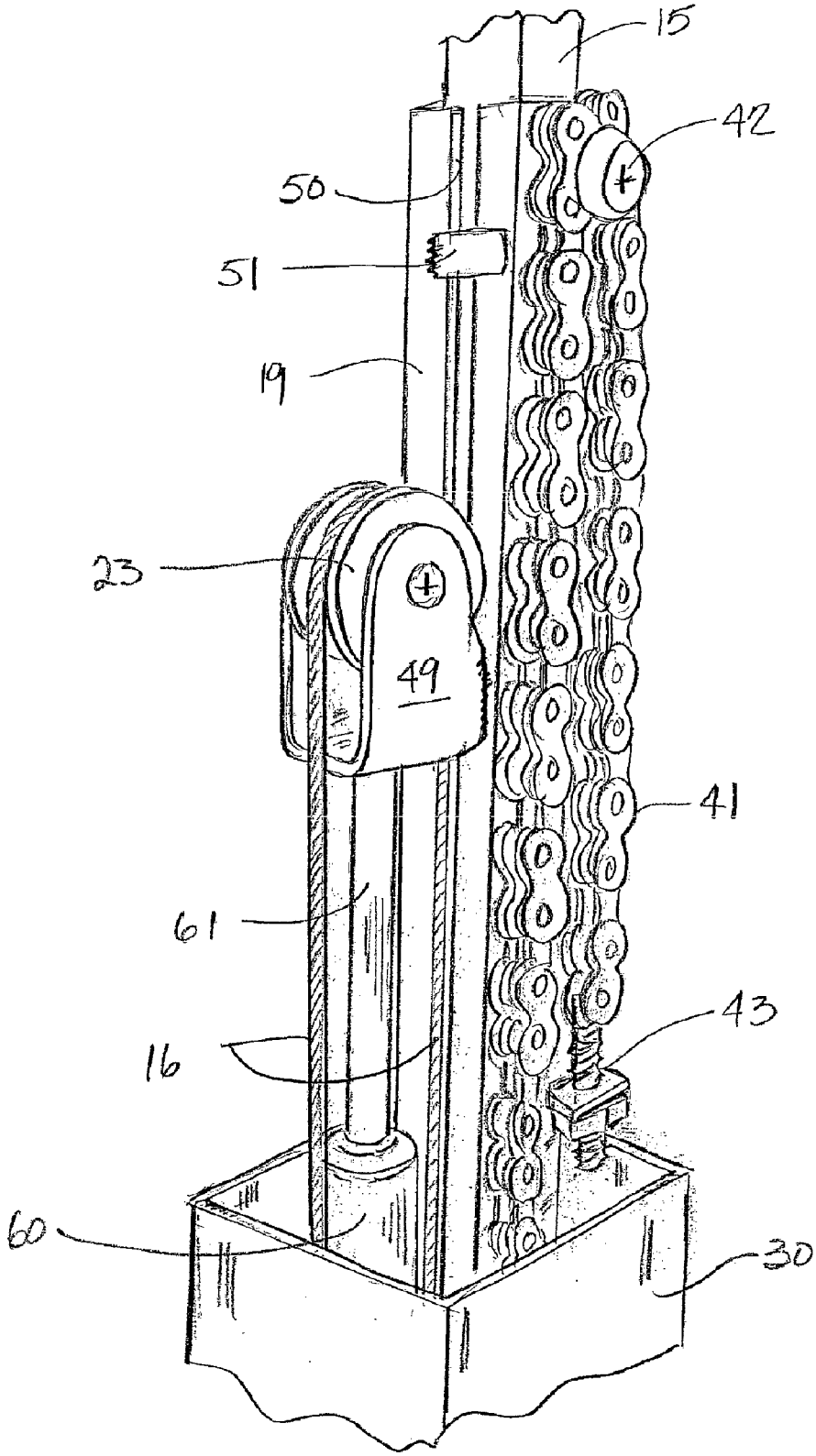
FIG. 13 is a partial perspective view of the embodiment of FIG. 11 illustrating the telescoping arrangement of the lift structures in the actuation means.
Figure 14:
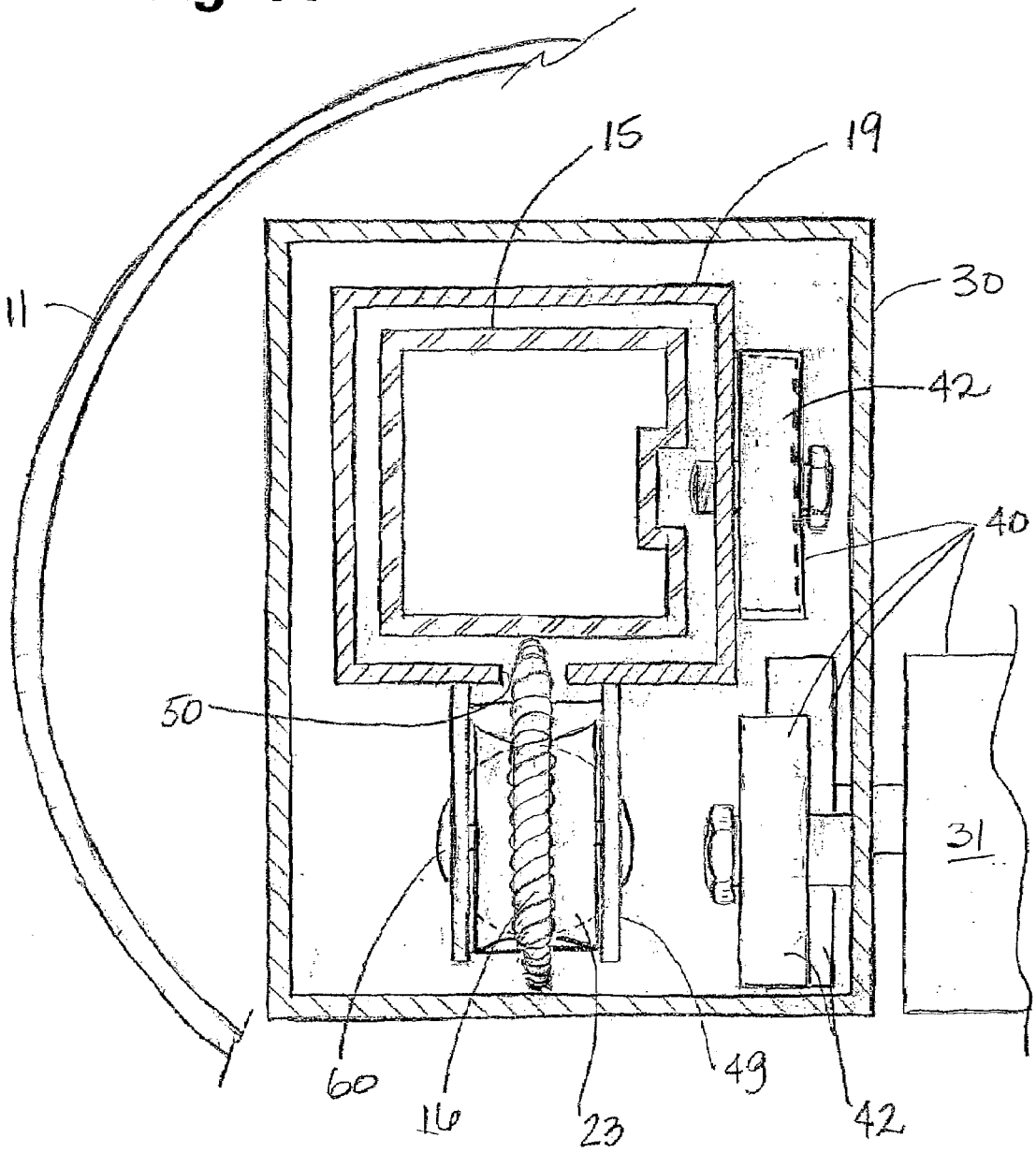
FIG. 14 is an end view of the actuation means according to FIG. 11, the tension member removed for clarity.

In a preferred embodiment, best seen in FIGS. 13 and 14, a slot 50 is formed along the length of the intermediate member 19 to accommodate connection of the cable 16 to the lower end 21 of the upper member 15 and to permit movement of the upper member 15 relative to the intermediate member 19 for telescoping therein. At least an upper stop 51 is formed along the slot 50 to assist in preventing the upper member 15 from lifting out of the intermediate member 19.

As shown in FIG. 14, the actuation members 4 in this embodiment are housed within telescoping tubular members 11 so as to aesthetically cover the lift structures 30, 19 and 15. An upper, lower and intermediate telescoping member (not shown) are connected to one or more of the lift structures 30, 19, 15 so as to move with the lift structures 30, 19, 15 as each are raised and lowered. For example, the upper telescoping member may be connected to the first lift structure 30 so that when the first lift structure 30 is lifted the upper telescoping member is raised at the same time. More preferably, the upper telescoping member is further connected to the intermediate telescoping member so that the intermediate telescoping member is passively raised to cover the second lift structure 19 when the first and second lift structures 30, 19 are raised.

Optionally, as shown in FIGS. 11-14 and in a preferred embodiment, a biasing means 60, such as a hydraulic cylinder, is connected between the lower housing 30 and the intermediate member 19 for assisting in lifting the intermediate member 19 to reduce load of the full weight of the cover 3 on the motor 31. Preferably, an actuating arm 61 of the hydraulic cylinder 60, such as a standard size 10 gas spring available from Industrial Gas Springs Ltd. of Mitcham, Surrey, CR4 4HR, United Kingdom, is connected to the intermediate member 19 through the bracket 49.

In a preferred embodiment, the cover 3 is a substantially rigid, domed pyramidal-shaped cover manufactured of a foam core and having a fabric covering such as is known in the industry to provide protection and insulation as is also known with conventional spa covers. Further, the domed shape is particularly advantageous for spas which are enclosed in a deck structure to prevent persons or animals from walking or lying on the cover 3 and to minimize the amount of snow buildup on the cover 3 in snow-prone climates.

What is claimed is:

1. A vertically-actuable cover assembly for a structure comprising:

a cover; and two or more actuation members for supporting the cover, the two or more actuation members being actuable between a lowered position atop the structure to an elevated position above the structure so as to act as a roof thereover, wherein the two or more actuation members further comprise:

a first lift structure mounted on a base fixed relative to the structure;

a second lift structure operatively connected to the first lift structure and actuable to be raised and lowered relative thereto;

a third upper lift structure operatively connected to the second lift structure connected to the cover for raising and lowering the cover;

a rotatable guide supported adjacent a top end of the second lift structure;

a first tension member connected between the first structure and extending about the rotatable guide for connection to a bottom end of the third lift structure; and drive means for driving the second lift structure to be lifted and lowered relative to the first lift structure, wherein the rotatable guide is lifted and lowered by the second lift structure so as to passively cause the first tension member to lift the third upper lift structure relative to the second lift structure so as to lift the cover.

2. The cover assembly of claim 1 wherein the actuation members are housed within a plurality of telescoping tubular members and connected thereto so as to raise and lower at least an upper and intermediate telescoping tubular member therewith.

3. The cover assembly of claim 2 wherein the plurality of telescoping tubular members are circular in cross-section.

4. The cover assembly of claim 1 wherein the first lift structure is a pinion driveably mounted on a rotatable member; and the second lift structure is a rack; and the drive means is connected to the rotatable member for rotating the pinion in engagement with the rack for raising and lowering the rack.

5. The cover assembly of claim 4 wherein the drive means for rotating the pinion in engagement with the rack is a motor.

6. The cover assembly of claim 4 wherein the pinion is a worm gear.

7. The cover assembly of claim 1 wherein:

the rotatable guide is a pulley connected at a top end of the rack; and the first tension member is a cable connected at a first end to the base and at a second end to the bottom of the third lift structure.

8. The cover assembly of claim 7 wherein the third lift structure is the upper telescoping tubular member connected at a top end to the cover.

9. The cover assembly of claim 1 further comprising:

limit switches in the rack and pinion system for stopping the drive means when the actuation members reach the elevated position or the lowered position.

10. The cover assembly of claim 1 wherein the structure is a spa.

11. The cover assembly of claim 1 further comprising four actuation members.

12. The cover assembly of claim 1 wherein:

the first lift structure is an upwardly linearly extending lower housing connected to the base;

the second lift structure is a linearly extending intermediate member housed telescopically within the first lift structure; and the drive means is a drivable second tension member extending in a figure-8, a first loop about rotatable guides positioned at a top and bottom of the first lift structure and a second loop about rotatable guides at a top and bottom of the second lift structure, at least one of the rotatable guides on the first lift structure being connected to a drive and wherein first and second ends of the second tension member are fixed to the second lift structure.

13. The cover assembly of claim 12 wherein the actuation members are housed within a plurality of telescoping tubular members and connected thereto so as to raise and lower at least an upper and intermediate telescoping tubular member therewith.

14. The cover assembly of claim 13 wherein the plurality of telescoping tubular members are circular in cross-section.

15. The cover assembly of claim 12 wherein the driver is a motor.

16. The cover assembly of claim 12 wherein the second tension member is a chain and the rotatable guides are sprockets.

17. The cover assembly of claim 12 wherein the third lift structure is a linearly extending upper member telescopically housed within the second lift structure and connected at a top end to the cover.

18. The cover assembly of claim 12 further comprising:

limit switches for stopping the driver when the actuation members reach the elevated position or the lowered position.

19. The cover assembly of claim 12 further comprising:

biasing means connected to the second lift structure for assisting in lifting the cover.

20. The cover assembly of claim 19 wherein the biasing means is a hydraulic cylinder supported by the base.

21. The cover assembly of claim 20 wherein the rotatable guide is a pulley rotatably mounted adjacent the top end of the second lift structure and to a top end of a linearly actuable hydraulic arm of the hydraulic cylinder.

22. An actuator for a vertically actuable cover assembly for a structure comprising:

a first lift structure adapted to be mounted on a base fixed relative to the structure;

a second lift structure operatively connected to the first lift structure and actuable to be raised and lowered relative thereto;

a third upper lift structure operatively connected to the second lift structure adapted for connection to the cover for raising and lowering the cover;

a rotatable guide supported adjacent a top end of the second lift structure;

a first tension member connected between the first structure and extending about the rotatable guide for connection to a bottom end of the third lift structure; and drive means for driving the second lift structure to be lifted and lowered relative to the first lift structure, wherein the rotatable guide is lifted and lowered by the second lift structure so as to passively cause the first tension member to lift the third upper lift structure relative to the second lift structure adapted so as to lift the cover.

23. The actuator of claim 22 wherein the actuator is housed within a plurality of telescoping tubular members and connected thereto so as to raise and lower at least an upper and intermediate telescoping tubular member therewith.

24. The actuator of claim 23 wherein the third lift structure is the upper telescoping tubular member is adapted for connection at a top end to the cover.

25. The actuator of claim 22 wherein the first lift structure is a pinion driveably mounted on a rotatable member; and the second lift structure is a rack; and the drive means is connected to the rotatable member for rotating the pinion in engagement with the rack for raising and lowering the rack.

26. The actuator of claim 25 wherein the pinion is a worm gear.

27. The actuator of claim 22 wherein:

the rotatable guide is a pulley connected at a top end of the rack; and the first tension member is a cable connected at a first end to the base and at a second end to the bottom of the third lift structure.

28. The actuator of claim 22 further comprising:

limit switches in the rack and pinion system for stopping the drive means when the actuation members reach the elevated position or the lowered position.

29. The actuator of claim 22 wherein:

the first lift structure is an upwardly linearly extending lower housing adapted for connection to the base;

the second lift structure is a linearly extending intermediate member housed telescopically within the first lift structure; and the drive means is a drivable second tension member extending in a figure-8, a first loop about rotatable guides positioned at a top and bottom of the first lift structure and a second loop about rotatable guides at a top and bottom of the second lift structure, at least one of the rotatable guides on the first lift structure being connected to a drive and wherein first and second ends of the second tension member are fixed to the second lift structure.

30. The actuator of claim 29 wherein the actuation members are housed within a plurality of telescoping tubular members and connected thereto so as to raise and lower at least an upper and intermediate telescoping tubular member therewith.

31. The actuator of claim 29 wherein the second tension member is a chain and the rotatable guides are sprockets.

32. The actuator of claim 29 wherein the third lift structure is a linearly extending upper member telescopically housed within the second lift structure and connected at a top end to the cover.

33. The actuator of claim 29 further comprising:

limit switches for stopping the driver when the actuation members reach the elevated position or the lowered position.

34. The actuator of claim 29 further comprising:

biasing means connected to the second lift structure adapted for assisting in lifting the cover.

35. The actuator of claim 34 wherein the biasing means is a hydraulic cylinder adapted to be supported by the base.

36. The actuator of claim 29 wherein the rotatable guide is a pulley rotatably mounted adjacent the top end of the second lift structure and to a top end of a linearly actuable hydraulic arm of the hydraulic cylinder.

* * * * *